United States Patent [19]

Fukuichi

[11] 4,209,972

[45] Jul. 1, 1980

[54] DIGITAL ELECTRONIC TIMEPIECE HAVING AN ALARM DISPLAY

[75] Inventor: Takuro Fukuichi, Tokyo, Japan

[73] Assignee: Kabushiki Kaisha Daini Seikosha, Tokyo, Japan

[21] Appl. No.: 915,178

[22] Filed: Jun. 14, 1978

[30] Foreign Application Priority Data

Jun. 17, 1977 [JP] Japan ..... 52-72576

[51] Int. Cl.[2] ..... G04F 10/00; G04C 19/02

[52] U.S. Cl. ..... 368/71; 368/66; 368/72; 368/101; 368/109

[58] Field of Search ..... 58/16 R, 16 D, 19 R, 58/19 C, 21.13, 23 BA, 38 A, 38 R, 57.5, 152 B, 152 H, 50 R, 39, 39.5, 74, 152 R; 235/92 T; 324/186

[56] References Cited

U.S. PATENT DOCUMENTS

| | | | |
|---|---|---|---|
| Re. 29,637 | 5/1978 | Takamune et al. | 58/152 H |
| 3,813,533 | 5/1974 | Cone et al. | 58/50 R |

*Primary Examiner*—Edith S. Jackmon

*Attorney, Agent, or Firm*—Robert E. Burns; Emmanuel J. Lobato; Bruce L. Adams

[57] ABSTRACT

A digital electronic timepiece having a multi-digit digital display for displaying the time count in a time counter which receives a divided down time signal from a time base signal generator. At least one settable time counter for storing a count corresponding to a desired time period is provided which is receptive of a time signal for decrementing the count thereof to zero. A plurality of display driving signals, each corresponding to one digit of display are generated wherein the display signals of successive digits are phase delayed with respect to each other and the frequency thereof is sufficiently low to produce visible flickering of display. Upon the sensing of the zero count in the timer counter, the display which is normally non-flickering, is driven with the display driving signals to produce a sequential flickering of the digits of the time display to provide a visual indication of the lapse of the desired time period.

4 Claims, 6 Drawing Figures

DIGITAL ELECTRONIC TIMEPIECE HAVING AN ALARM DISPLAY

BACKGROUND OF THE INVENTION

The present invention relates to a display for an electronic timepiece having a timer.

In the conventional type, an alarm means emits a sound whereby a buzzer or speaker are necessarily provided. Therefore, it is very difficult to make a thin type wrist watch and to freely design the timepiece.

SUMMARY OF THE INVENTION

The object of the present invention is to make an electronic timepiece having a timer for generating an alarm of the display type.

DETAILED DESCRIPTION OF THE INVENTION

Figure 1:
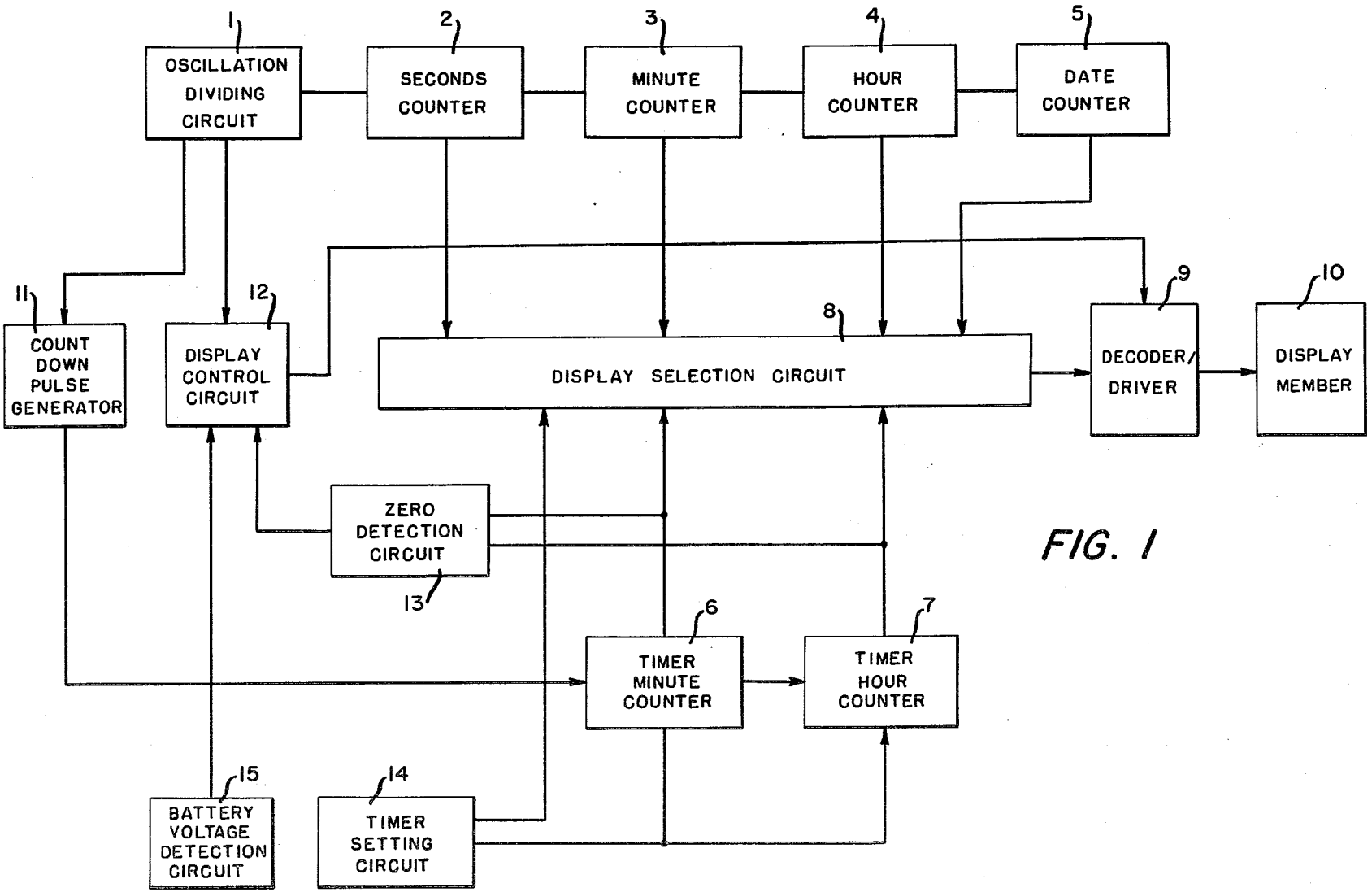
FIG. 1 shows a circuit block of one embodiment of the present invention.

Referring now to a preferred embodiment of the present invention:

FIG. 1 shows a basic circuit block diagram of one embodiment of the present invention.

Numeral 1 is an oscillating dividing circuit 1 for generating a signal of a time standard and for generating a one second signal, a seconds counter 2 generates a one minute signal by applying the one second signal of said oscillating dividing circuit 1 thereto, a minute counter 3 generates a one hour signal by applying the one minute signal of said seconds counter 2 thereto, an hour counter 4 generates a day signal by applying the one hour signal of said minute counter 3 thereto and, a day counter 5 counts until 31 dates by applying the one day signal of said hour counter 4 thereto.

Said circuits and counters 1, 2, 3, 4 and 5 are respectively connected in series and comprise a first counter for counting a normal time.

The time contents of said seconds counter 2, minute counter 3, hour counter 4 and date counter 5 are connected to one input terminal of a display selection circuit 8 and are displayed to a display member 10 through a decoder/driver 9.

A timer minute counter 6 and timer hour counter 7 for setting a timer time are respectively connected in series, and are connected to the other input terminal of a display selection circuit 8, and the time contents of said first counter or the time contents of the timer counter are selectively generated by a signal from a timer setting circuit 14.

Further, the time contents of said timer minute counter 6 and timer hour counter 7 are respectively applied to a zero detection circuit 13 and the outputs of said zero detection circuit 13 and a battery voltage detection circuit 15 are applied to a display control circuit 12. Said display control circuit 12 generates a pulse signal by collecting the preferable signals from a dividing stage of said oscillating dividing circuit 1, and controls said decoder/driver 9.

Said timer minute counter 6 and timer hour counter 7 collect the desired signals from a dividing stage of said oscillating dividing circuit 1, and are connected to a down counting pulse generator 11 which generates a down counting pulse.

Said display selection circuit 8 selects the timer by the operation of said timer setting circuit 14 whereby a certain time is set into said timer minute counter 6 and timer hour counter 7. For example, if its time is one hour, the time contents of said timer minute counter 6 and timer hour counter 7 are gradually counted down according to a lapse of time, the contents of said timer minute counter 6 and timer hour counter 7 become zero after the elapsed one hour. At this time, said zero detection circuit 13 generates a signal, the display control circuit 12 is turned "ON" wherebby a display condition is differed from a normal display condition through said decoder/driver 9, said condition is shown in FIG. 2 and so on.

Figure 2:
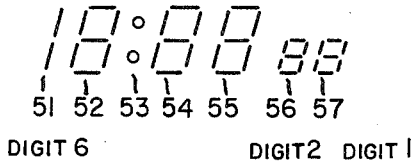
FIG. 2 shows a digital construction of a display member.

According to FIG. 2, digit 1 is numeral 57, digit 2 is numeral 56, digit 3 is numeral 55, digit 4 is numeral 54, digit 5 is numeral 52, digit 6 is numeral 51 and a colon is numeral 53.

Figure 3:
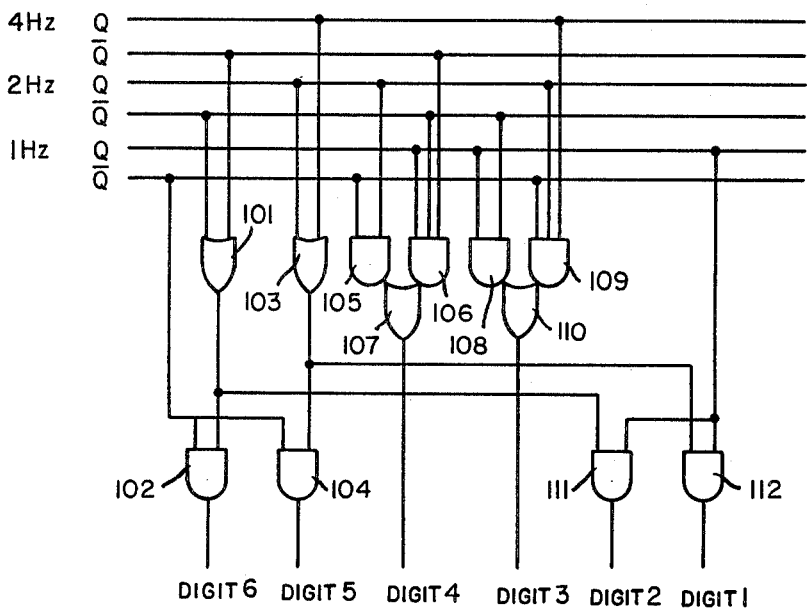
FIG. 3 shows a gate-circuit for generating a signal for changing the display construction of the present invention.
Figure 4:
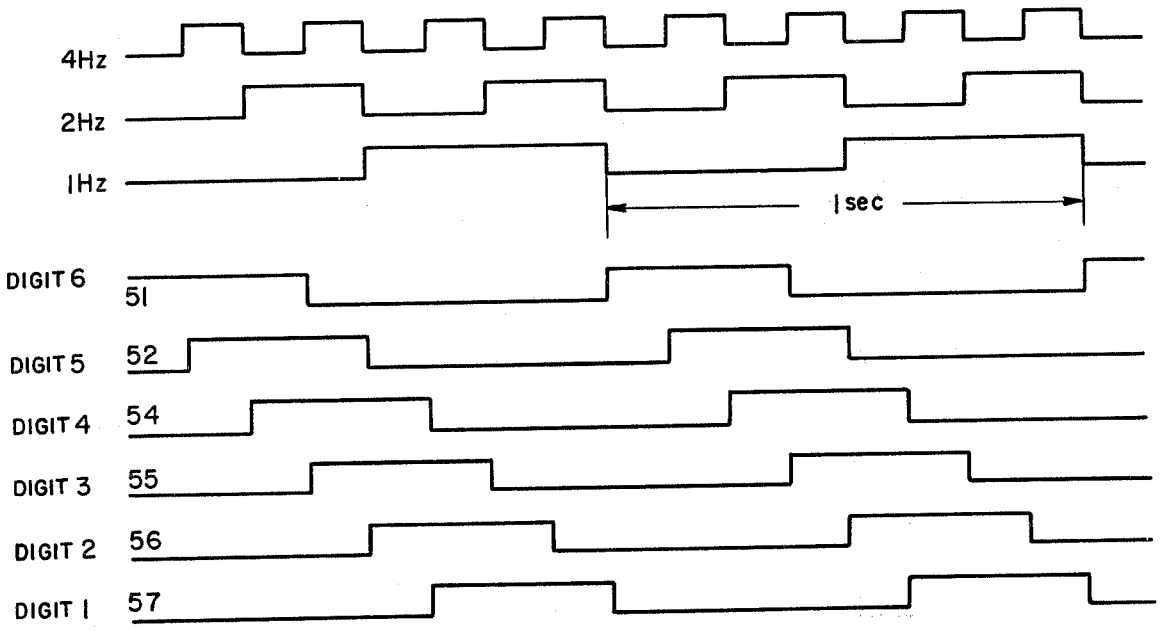
FIG. 4 shows a timing chart for indicating the output signal.

FIGS. 3 and 4 show a circuit construction and a timing chart in the case of a display condition which is seen as a flowing type.

According to the present embodiment, the displays in each of digits are controlled, further one is able to control the displays every hour, minute and second.

Referring now to FIG. 3, Q and $\overline{Q}$ of 4 Hz, 2 Hz and 1 Hz are respectively produced from the dividing stage of the oscillating dividing circuit 1, whereby the signals for controlling the digits are produced by the gate circuits as explained. A signal for controlling digit 6 is generated by the output signal AND gate 102 having as one input, the output of OR-gate 101 having two input signals of $\overline{Q}$ of 4 Hz and $\overline{Q}$ of 2 Hz and as another input signal $\overline{Q}$ of 1 Hz. A signal for controlling digit 5 is generated by AND gate 104 having as an input, the output signal of OR-gate 103 having two input signals of Q of 4 Hz and Q of 2 Hz and having as another input signal $\overline{Q}$ of 1 Hz. A signal for controlling digit 4 is generated by the output signal of OR-gate 107 having two input signals of the output of AND-gate 106 which has input signals $\overline{Q}$ of 4 Hz, $\overline{Q}$ of 2 Hz and Q of 1 Hz and the output of AND-gate 105 which has input signals Q of 2 Hz and $\overline{Q}$ of 1 Hz.

A signal for controlling digit 3 is generated by the output signal of OR-gate 110 having two input signals of the output of AND-gate 108 which has input signals $\overline{Q}$ of 2 Hz and Q of 1 Hz and the output signal of AND-gate 109 which has the input signals Q of 4 Hz and 2 Hz and $\overline{Q}$ of 1 Hz. A signal for controlling digit 2 is generated by the output of AND-gate 111 having the inputs of the output of said OR-gate 101 and the signal "Q" of 1 Hz. Further, a signal for controlling digit 1 is generated by the output of AND-gate 112 having the inputs of the output of said OR-gate 103 and the signal "Q" of 1 Hz.

The signals of said digits 1–6 by said gate-circuits are shown in FIG. 4. Namely, each of the digits is kept at the "H" level for 375 m sec in 1-second, and the times of the "H" level are respectively slipped every 125 m sec.

Figure 5:
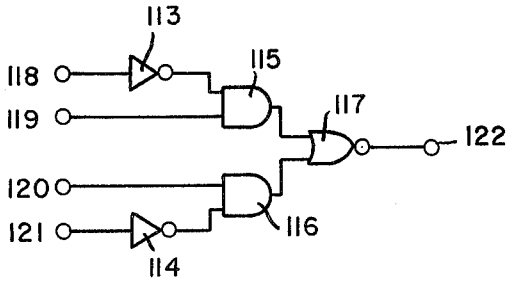
FIGS. 5 and 6 shows circuits for controlling the display.

FIG. 5 shows a digit control gate circuit for each digit for changing the display construction when a low voltage condition of battery power is detected or the timer contents becomes zero. The signal for displaying the display when the timer contents are zero as shown in FIG. 3 and FIG. 4 is applied to the terminal 118, and is connected to one input terminal of AND-gate 115 through the inverter 113.

The output of the zero detection circuit 13, which becomes "H" when a timer zero in detected, is connected to the terminal 119, and is connected to the other input terminal of AND-gate 115. The output of a battery voltage detection circuit 15 which generates an "H" signal for a low battery voltage is connected to the terminal 120, and is connected to one input terminal of AND-gate 116.

The signal for displaying the display in the low voltage condition is applied to the terminal 121. For example, if we wish to flash all of the display digits by the 1 Hz signal, it is necessary to connect the output signal of 1 Hz of the oscillation dividing circuit 1. The signal of the terminal 121 is connected to the other input terminal of AND-gate 116 through the inverter 114. The outputs of AND-gates 115 and 116 are applied to NOR gate 117, and the output of NOR-gate 117 is connected to the terminal 122.

When a set time has elapsed and the timer minute and hour counters 6 and 7 become zero, the zero detection circuit 13 generates a signal "H" whereby AND-gate 115 turns "ON".

At this time, the output of AND gate 102 as shown in FIG. 3 for digit 6 is applied to the terminal 118. Similarly, the output of gates 104, 107, 110–112 are also applied to a group of gates as shown in FIG. 5 which are provided so as to correspond to each of the digits.

Therefore, when the timer contents become zero, a signal of AND-gate 102 for digit 6 applied to the output terminal 122 of NOR-gate 117. Further, in case of a low condition of the battery voltage, a signal of the terminal 121 is similarly applied to the terminal 122 since the terminal 120 is "H" and AND-gate 116 becomes "ON".

When the timer is not zero and battery voltage is not low, AND-gates 115 and 116 are maintained in the "OFF" condition, the outputs thereof are maintained in the "L" condition, whereby the output terminal 122 of NOR-gate 117 is maintained in the "H" condition.

Figure 6:
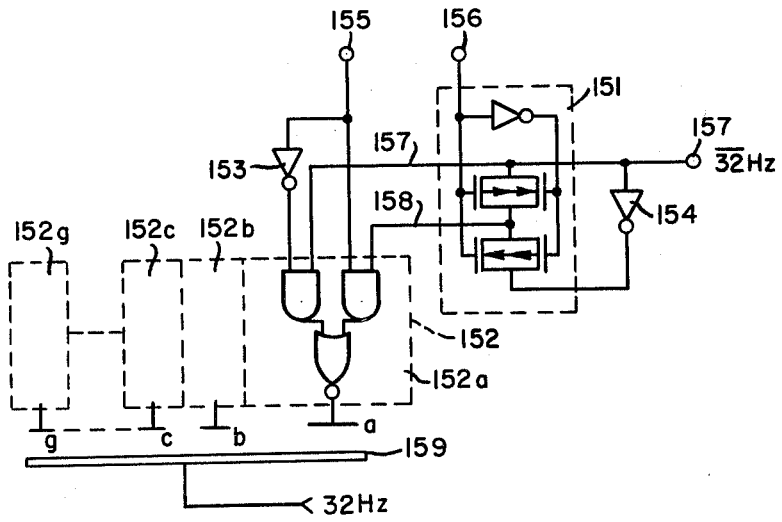

FIG. 6 shows a circuit for each digit controlling of a display having for each digit, a driving circuit and a display member.

A selection circuit 151 having a transmission-gate is controlled by a signal of a terminal 156 whereby it is determined whether a normal display driving signal of a terminal 157 (for example $\overline{32}$ Hz) should be directly generated to an output terminal 158 or the 32 Hz signal should be generated to said output terminal 158 through an inverter 154.

The output terminal 122 of NOR-gate 117 in FIG. 5 is connected to the terminal 156. The output terminals 157 and 158 of the selection circuit 151 is connected to AND-NOR gate 152. In the drawings, the terminals 157 and 158 are only connected to AND-NOR gate **152*a*, however, said terminals 157 and 158 are also connected to other AND-NOR gates 152*b*–152*g***.

The output of AND-NOR gate 152 is connected to the segments a–g of the display member, a display of alpha numerals are displayed by a differential voltage to the signal (for example 32 Hz) which is applied to a common electrode 159.

In a normal display condition, the terminal 122, i.e. terminal 156 is in the "H" condition whereby the signal $\overline{32\ Hz}$ is applied to the output terminal 157, further the signal 32 Hz is applied to the terminal 158. At this time, if the terminal 155 is in the "H" condition, the signal $\overline{32\ Hz}$ is applied to the segment "a" whereby said segment is in a "a" display condition.

If the terminal 155 is in the "L" condition, through the inverter 153 the signal 32 Hz is applied to the segment "a" whereby said segment "a" is not displayed.

Further, if a signal of digit 6 is applied to the terminal 156, the segments which are in the "H" condition by the signal of the terminal 155 are only displayed during the time said signal of digit 6 is maintained in the "H" condition. On the contrary, when said signal of digit 6 is in the "L" condition, all of segments are not displayed in spite of the signal of the terminal 155.

According to the use of the circuits of FIG. 5 and 6 for each digit, each digit is displayed only during the signal which is shown in FIG. 4 in the "H" condition and are not displayed during the "L" condition whereby a display having a flowing appearance is obtained i.e. each digit is sequentially displayed.

In the case of low condition of battery voltage, the display is displayed in a similar way, i.e. displayed when the signal 1 Hz is in the "H" condition and not displayed when in the "L" condition.

According to the present invention, when a timer set time has come, the display condition is remarkably differed from the normal condition i.e. the digits are sequentially displayed whereby it is not necessary to use a sound alarm.

I claim:

1. A digital electronic timepiece comprising: a power source; a time base signal generator; a divider receptive of the time base signal for generating a plurality of time signals; at least one time counter receptive of one time signal for counting time; at least one settable timer counter for storing a count corresponding to a desired time period and receptive of a time signal for decrementing the count thereof to zero; a multi-digit digital display for displaying the time count in the counter; means for generating a zero count signal when the timer count is zero; means for generating a plurality of display driving signals each corresponding to one digit of the display, wherein the display driving signals of successive digits are phase delayed with respect to each other and the frequency thereof is sufficiently low to produce visible flickering of the display; and means for normally applying a given time signal to the display to produce a non-flickering time display and responsive to a zero count signal in the timer counter for applying the display driving signals to the display to produce a sequential flickering of the digits of the time display to provide a visual indication of the lapse of said desired time period.

2. The timepiece according to claim 1, wherein the power source comprises a battery and further comprising means for sensing a low voltage condition of the battery to generate a low voltage signal and wherein the means for applying includes means for applying the display driving signals in response to the low voltage signal.

3. The timepiece according to claim 2; wherein the means for generating the display driving signals comprises a plurality of gating circuits receptive of 1 Hz, 2 Hz and 4 Hz time signals from the divider for generating a plurality of phase delayed overlapping signals each second corresponding in number to the number of display digits.

4. The timepiece according to claim 2, wherein the means for applying comprises a selection circuit for each digit receptive of one display driving signal and the given time signal and responsive to the zero count signal and the low voltage signal for alternatively applying the display driving signal and the given time signal to the digit display.

* * * * *